US005100337A

United States Patent [19]

Lee Chao

[11] Patent Number: 5,100,337

[45] Date of Patent: Mar. 31, 1992

[54] ELECTRICAL CONNECTOR FOR EXERTING MULTIPLE ELASTIC FORCES

[76] Inventor: Kuei L. Lee Chao, C/O: Hung Hsing Patent Service Center, P.O. Box 55-1670, Taipei, Taiwan

[21] Appl. No.: 644,313

[22] Filed: Jan. 22, 1991

[51] Int. Cl.[5] ..... H01R 13/62

[52] U.S. Cl. ..... 439/326; 439/62; 439/636

[58] Field of Search ..... 439/326-329, 439/629-637, 59-62

[56] References Cited

U.S. PATENT DOCUMENTS

| | | | |
|---|---|---|---|
| 3,732,531 | 5/1973 | Bouley | 439/636 |
| 4,737,120 | 4/1988 | Grabbe et al. | 439/328 |
| 4,984,996 | 1/1991 | Watanabe | 439/326 |
| 4,995,825 | 2/1991 | Korsunsky et al. | 439/328 |
| 4,998,890 | 3/1991 | Tuan | 439/326 |
| 5,004,429 | 4/1991 | Yagi et al. | 439/326 |

*Primary Examiner*—David L. Pirlot

[57] ABSTRACT

An electrical connector includes a plurality of contact elements each contact element formed with two spring arm members and two contacting protrusions disposed in a slot formed in a connector base for homogeneously exerting multiple elastic forces on the contact element for firmly clamping a daughter printed circuit board thereon in order to efficiently clamp the daughter board to a mother printed circuit board connected with the electrical connector. The electrical connector also includes a pair of metal latches respectively embedded on two opposite end portions of a connector base of the electrical connector for resiliently holding the daughter board for prolonging a service life of the latches of the connector.

1 Claim, 5 Drawing Sheets

ELECTRICAL CONNECTOR FOR EXERTING MULTIPLE ELASTIC FORCES

BACKGROUND OF THE INVENTION

U.S. Pat. No. 4,737,120 of Grabbe et al. disclosed an electrical connector having a contact 36 for connecting the daughter board 18 with the mother board 34, including a spring 68 for resiliently clamping the board 18 by the two contact portions 66, 50. Since the spring 68 is closely adjacent to the right contact portion 66, a single side resilience force will act upon the right-leaf contact portion 66 to unbalancedly bias the upper projection 72 of the right contact portion 66 against the lower projection 60 of the left contact portion 50, causing a great bending moment and internal stress in the contact 36. The integral contact 36 is not provided with efficient means for releasing such a stress, thereby still easily causing deformation of the contact elements and poor electrical connection. The latch member 12 is made of plastic material which will be easily broken after repeated services.

The present inventor has found the drawbacks of the conventional electrical connector, and invented the present electrical connector capable of exerting multiple elastic forces for efficiently clamping a printed circuit board.

SUMMARY OF THE INVENTION

The object of the present invention is to provide an electrical connector having a contact element formed with two spring arm members and two contacting protrusions disposed in a slot formed in a connector base for homogeneously exerting multiple elastic forces on the contact element for efficiently connecting a printed circuit board thereon.

Another object of the present invention is to provide a pair of metal latches respectively embedded on two opposite end portions of a connector base of the electrical connector for resiliently holding the daughter board for prolonging a service life of the latches of the connector.

DETAILED DESCRIPTION

Figure 1:
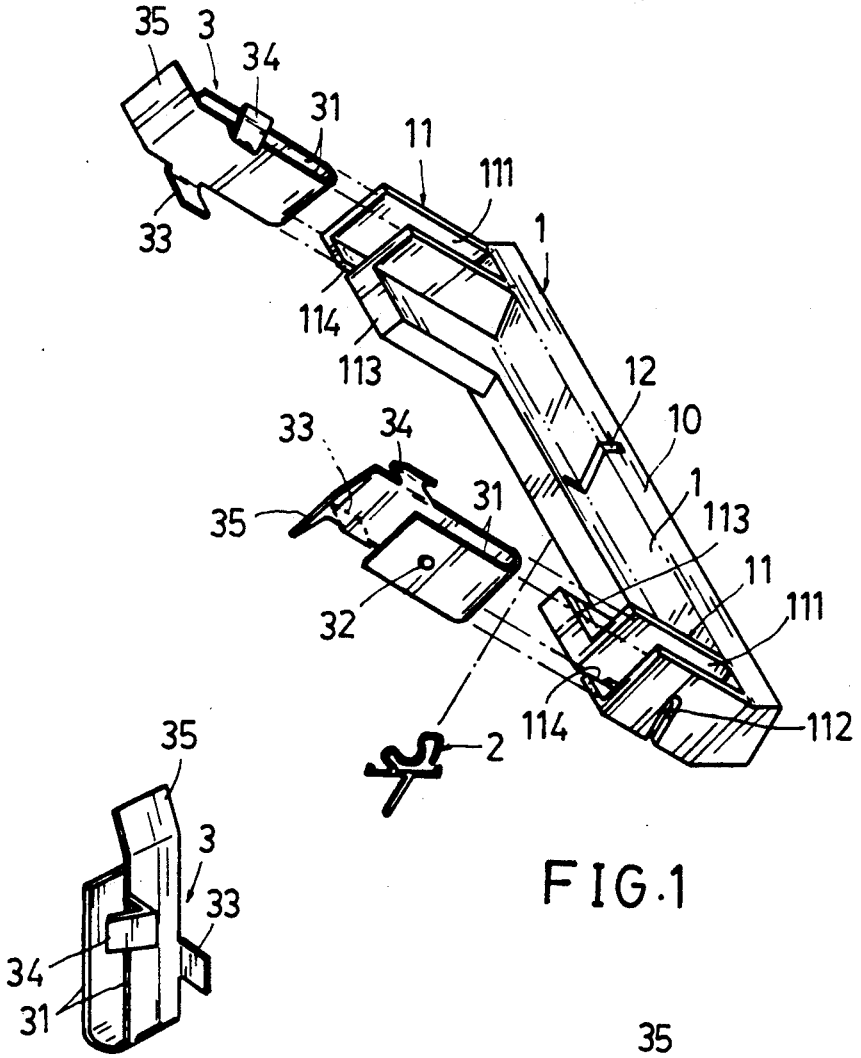
FIG. 1 is a perspective view showing all elements in construction of the present invention.

As shown in FIGS. 1-5, the present invention comprises: an electrical connector 1 for connecting a daughter printed circuit board 4 thereon, having a plurality of contact elements 2 embedded in the connector 1 for electrically connecting the daughter printed circuit board 4 with a mother printed circuit board 5, and a pair of metal latches 3 embedded in two opposite end portions of the connector 1.

Figure 4:
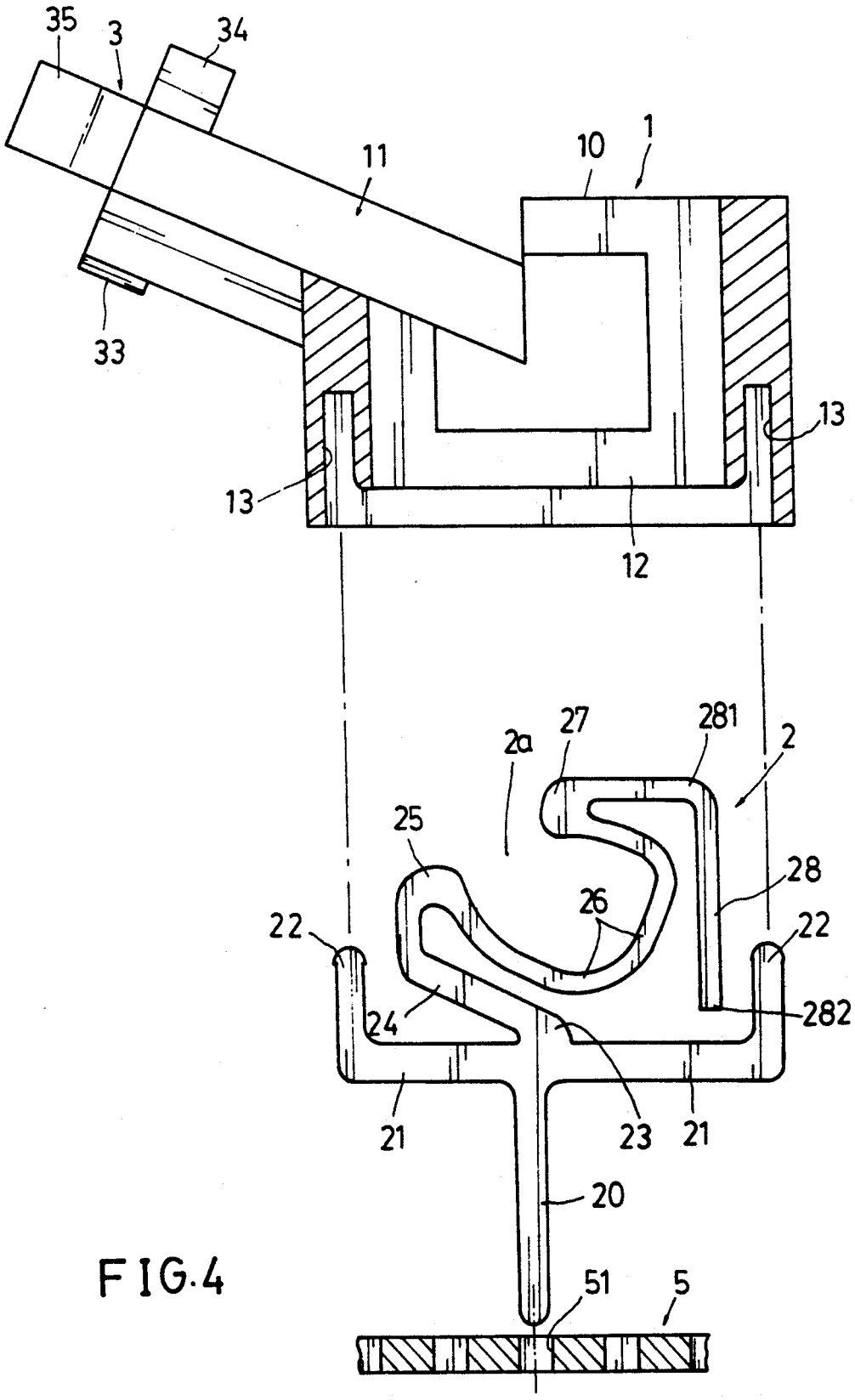
FIG. 4 is an illustration showing the contact element of the present invention.
Figure 5:
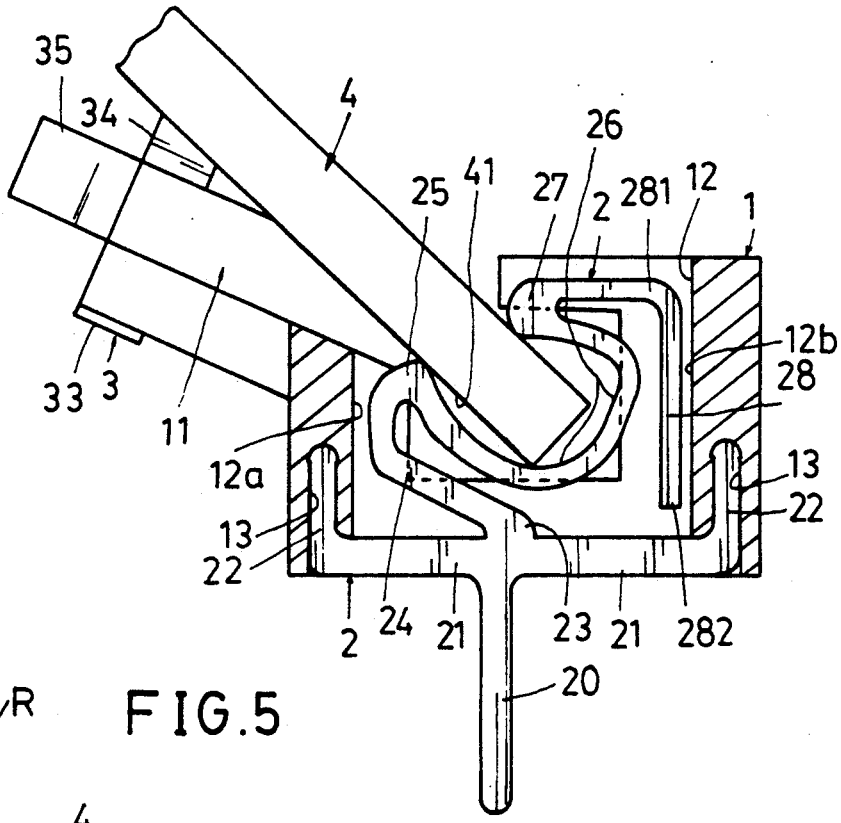
FIG. 5 shows a first step for inclinedly inserting a daughter printer circuit board in the connector of the present invention.

As shown in FIGS. 5, 4, the contact element 2 of the present invention made of electrically conductive material includes: a base member 21 embedded in a bottom portion of a slot 12 formed in a connector base 10 of the electrical connector 1, a leg member 20 protruding downwardly from the base member 21 to be fixed into each leg hole 51 formed in the mother board 5, at least a male engaging member 22 engageable with a female hole 13 formed in the connector base 10 of the connector 1, a pivot portion 23 formed on the base member 21 generally positioned at a central portion of the base member 21, a first spring arm member 24 secured to the pivot portion 23 protruding sidewardly towards a first side wall **12*a* in the slot 12, a first contacting protrusion 25 formed as a convex portion adjacent to the first spring arm member 24, a concave linking member 26 concave downwardly from the first contacting protrusion 25, a second contacting protrusion 27 connected with the concave linking member 26 and formed as another convex portion for facing the first contacting protrusion 25 and defining an aperture 2*a* between the two protrusions 27, 25, and a second spring arm member 28 adjacent to the second contacting protrusion 27 protruding sidewardly towards a second side wall 12*b* in the slot 12 opposite to the first side wall 12*a***.

The second spring arm member 28 includes an upper bending portion 281 secured to the second contacting protrusion 27 and a lower free end portion 282 pendant to approximate the base member 21.

The first spring arm member 24, the first contacting protrusion 25, the concave linking member 26, the second contacting protrusion 27 and the second spring arm member 28 commonly define an inversed omega shape.

Figure 2:
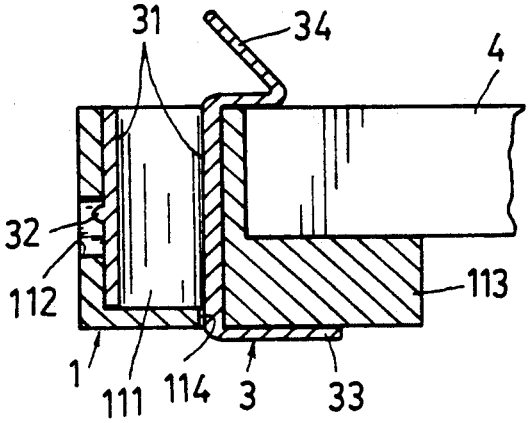
FIG. 2 is a top view showing a metal latch in accordance with the present invention.
Figure 3:
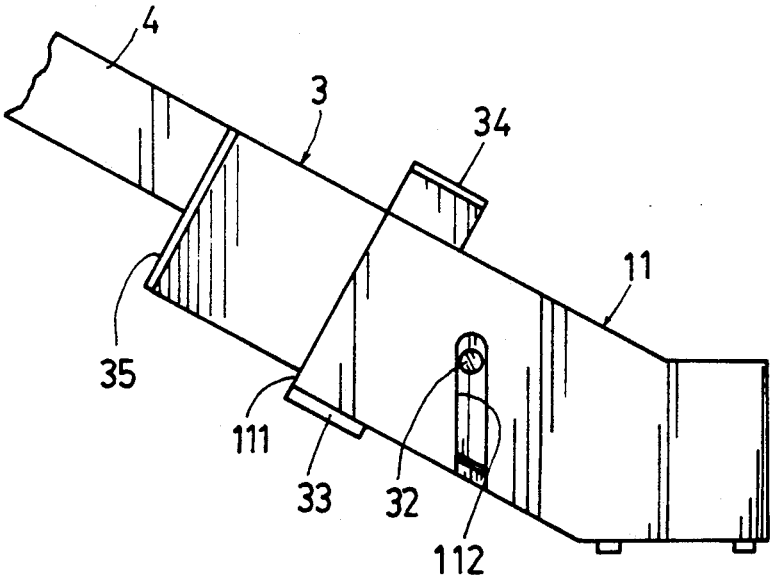
FIG. 3 is a side view of the metal latch of the present invention.

As shown in FIGS. 1-3, the electrical connector 1 of the present invention includes: the connector base 10 generally formed as an elongate shape, a plurality of slots 12 juxtapositionally laterally formed in the base 10 for embedding the plurality of contact elements 2 therein, a pair of latch holders 11 respectively formed on two opposite end portions of the elongate connector base 10, and the two metal latches 3 each embedded in each latch holder 11.

Each latch holder 11 includes: a latch socket 111 recessed in the holder 11, a protrusion slit or opening 112 formed in a right or a left end wall of the holder 11, a stop member 113 protruding inwardly from a rear side portion of the holder 111, and a clip opening 114 notched in the rear side portion of the holder 11.

Each metal latch 3 includes: a lower spring portion 31 having a longitudinal cross section generally U shaped engageably embedded in the latch socket 111 in the holder 11, a locking protrusion 32 protruding outwardly from the lower spring portion 31 to be engageable with the protrusion slit or opening 112 formed in the holder 11, a holder clip 33 protruding inwardly from a rear side portion of the latch 3 insertable in the clip opening 114 to be retained on the stop member 113, a board spring clip 34 protruding inwardly from a front side portion of the latch 3 for clamping the daughter printed circuit board 4 inserted into the connector base 10 of the connector 1 against the stop member 113 of the holder 11, and a depression plate 35 formed on an upper portion of the latch 3 inclinedly or arcuately bent outwardly.

In mounting the daughter board 4 into the connector 1 of the present invention, the board 2 is inclinedly inserted into the base 10 to be clamped by the two metal latches 3 as shown in FIGS. 2, 3.

Figure 6:
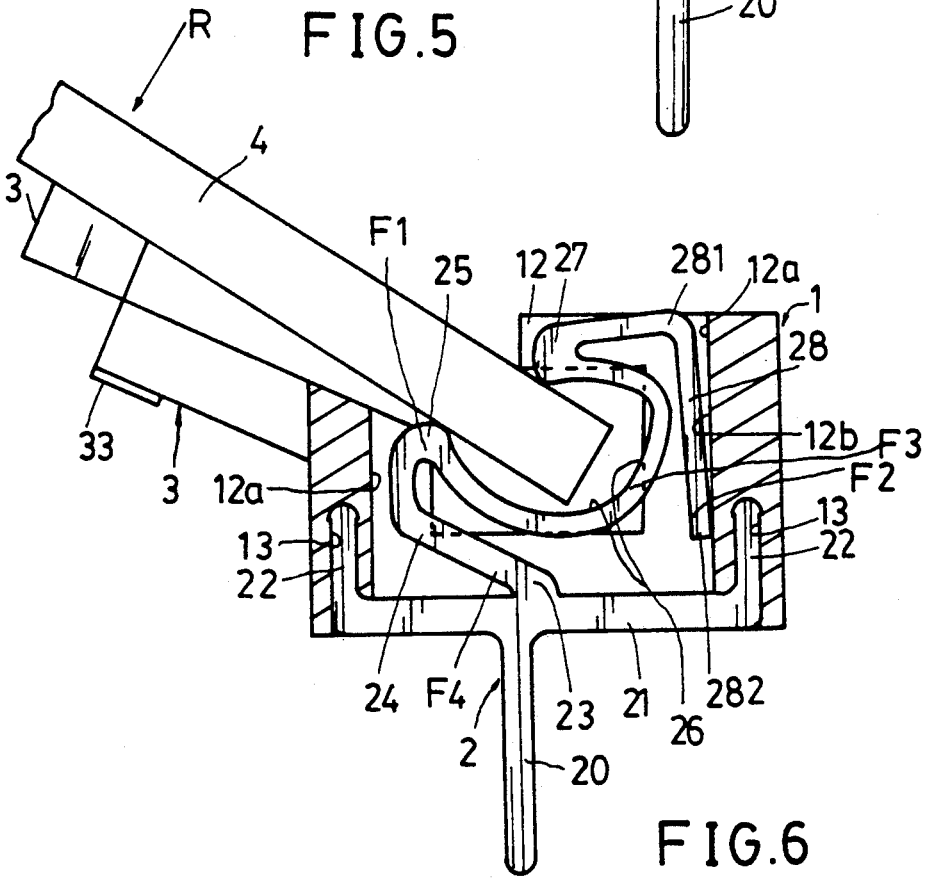
FIG. 6 shows a second step for inserting the daughter board of the present invention.
Figure 7:
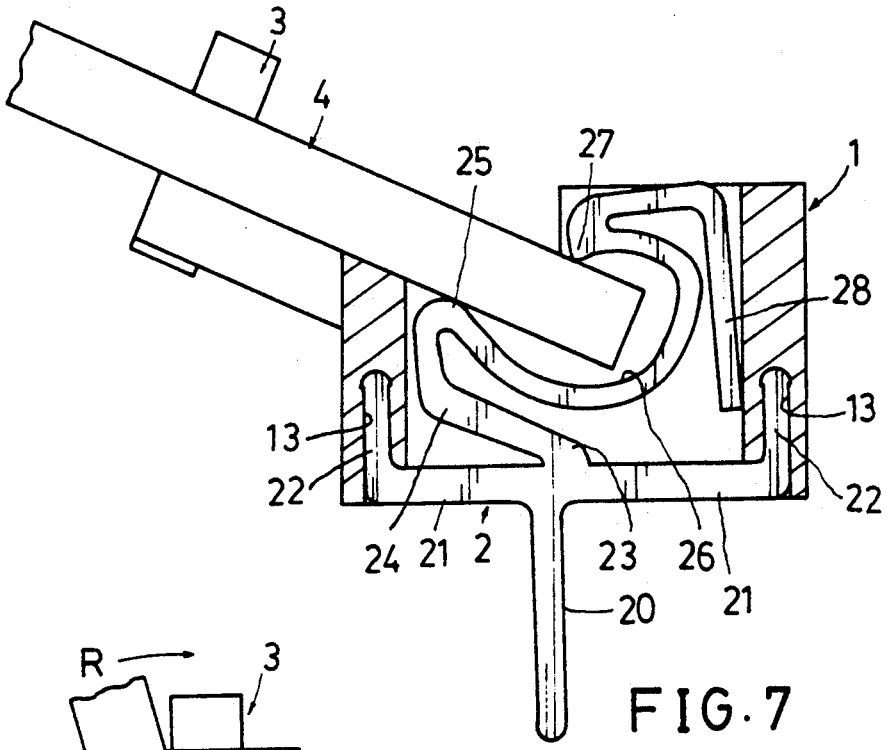
FIG. 7 shows a third step for inserting the daughter board in accordance with the present invention.

Referring now to FIGS. 5–7, the lower contact area 41 of the daughter board 4 is inclinedly inserted into the aperture 2*a* of the two contacting protrusions 25, 27 of the contact element 3 as shown in FIG. 5. By depressing the board 4 in direction R as shown in FIG. 6, the first contacting protrusion 25 will exert a first elastic force F1 on the convex portion of the protrusion 25 acting upon the left side of the lower portion of the board 4, and then the concave linking member 26 and the second contacting protrusion 27 will be twisted upwardly to bias the second spring arm member 28 upwardly, forcing the lower free end portion 282 of the second spring arm member 28 to bear against the second side wall 12*b* in the slot 12 and thereby to form a second elastic force F2 against the side wall 12*b*. The continuous depressing rotation (R) of the board 4 counterclockwise as shown in FIG. 6 will raise and enlarge the concave member 26 to increase its elastic force, the third elastic force F3. Finally, a fourth elastic force F4 will be continuously formed at the first spring arm member 24.

The four elastic forces F1, F2, F3 and F4 will be synergetically added to increase the clamping force of the two protrusions 25, 27 for efficiently clamping the daughter board 4 for enhancing a sound electrical connection among the daughter board 4, the contact elements 2, and the mother board 5.

When it is intended to replace the daughter board 4 from the connector 1, the two depression plates 35 of the two latches 3 are depressed downwardly to release the board 4 which is then automatically recovered to its original inserting position from the clamped contact elements 2 embedded in the connector slot 12 as urged by the multiple elastic forces F1–F4 effected by each contact element 2.

Since the elastic forces F1–F4 are distributed between the two arm members 24, 28 and between the two protrusions 25, 27, the contact element 2 after being withdrawn from its clamped board 4 will immediately release their elastic forces without accumulating any internal stress which may easily cause deformation of the contact element.

When re-inserting the board 4 into the contact elements 2, the aforementioned multiple elastic forces will be homogeneously exerted to efficiently clamp the board 4 without being overstressed or unbalancedly stressed, thereby preventing permanent set or deformation of the contact element.

During the handling, transportation and using of the present invention, any external forces such as a vibrational shock acting upon each contact element 2 will be uniformly absorbed or reduced by the inversed-omega-shaped contact element 2 of this invention, thereby preventing any disadvantages caused by the external forces.

Besides, the metal latch 3 will prolong its service life after frequent repeated depression operation cycles in inserting or withdrawing the board 4 in and from the connector 1 to be superior to the conventional connector with plastic latch members.

Therefore, the present invention is superior to a conventional electrical connector.

Figure 8:
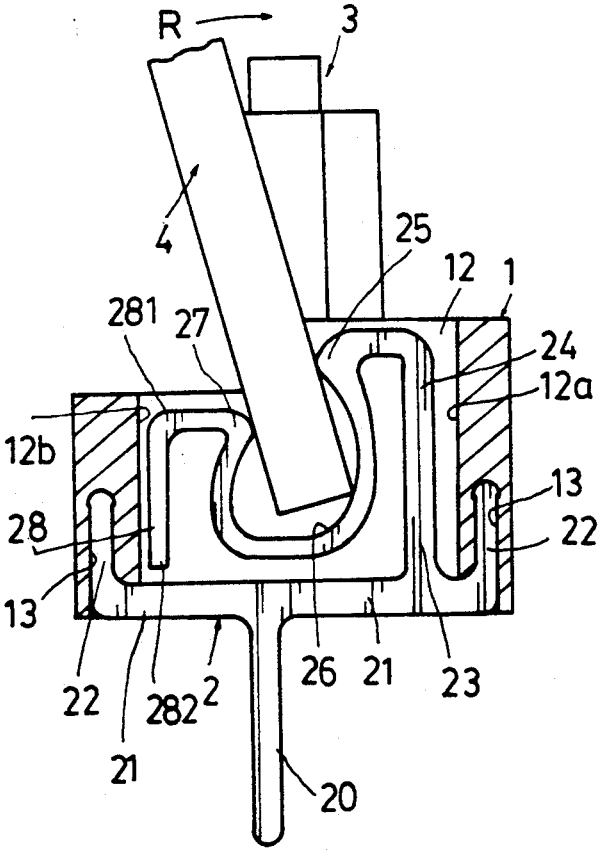
Fig. 8 shows another preferred contact element of the present invention.

Another preferred embodiment of the present invention is shown in FIG. 8, which includes a contact element 2 having a pivot portion 23 protruding upwardly from the base member 21 adjacent to a side wall 12*a* of the slot 12 and having a first contacting protrusion 25 slightly higher than a second contacting protrusion 27, which is different from the example as shown in FIG. 4 having the second contacting protrusion 27 slightly higher than the first contacting protrusion 25. After depressing and rotating the inserted daughter board 4 in direction R, the board 4 will be vertically erected.

Figure 9:
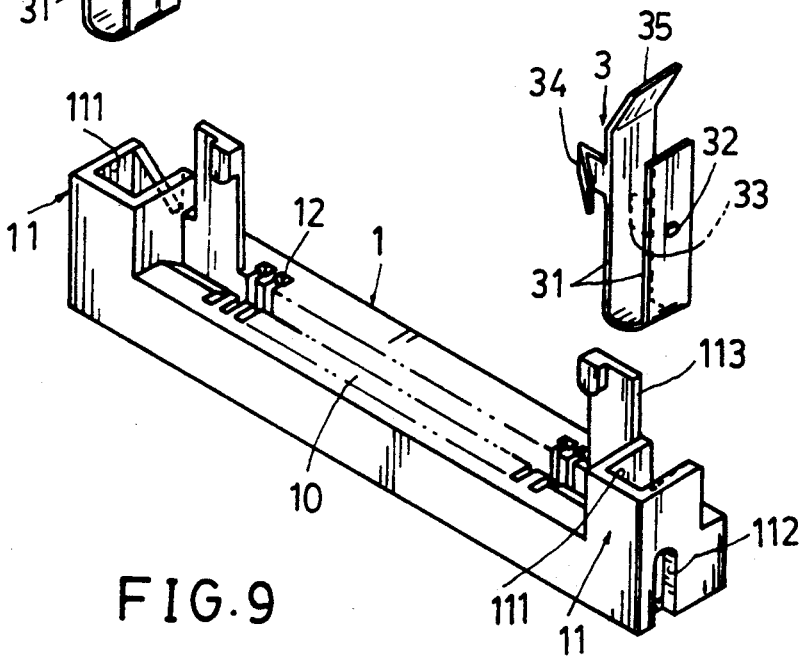
FIG. 9 shows another preferred embodiment of the metal latches and their holder of an electrical connector of the present invention.

Still another preferred embodiment of the present invention is shown in FIG. 9 having a vertical structure of the latch holders 11 and metal latches 3. The construction and structure of each latch holder 11 and metal latch 3 is similar to that as aforementioned.

The present invention may be further modified without departing from the scope and spirit of this invention.

What is claimed is:

1. An electrical connector having at least one contact element mounted in said connector for electrically connecting a daughter printed circuit board insertable in said contact elements and a mother printed circuit board connected to said connector.

an elongate connector base having a transverse slot corresponding to each contact element, said slot being defined by a first and a second side wall.

a pair of latch holders respectively formed on two opposite end portions of said connector base, and two latches, each said latch mounted in each said latch holder for resiliently and detachably holding the daughter printed circuit board in said connector base of said connector;

said contact element being made of an electrically conductive material and including;

a base member mounted in said slot of said connector base, a leg member protruding downwardly from said base member to be fixed to the mother board, at least a male engaging member formed on the base member engageable with a female hole formed in the connector base of the connector, a pivot portion formed on the base member, a first spring arm member secured to the pivot portion and having at least a portion thereof proximate to said first side wall in the slot, a first contacting protrusion formed as a convex portion adjacent to the first spring arm member for contacting a first side of a contact area of said daughter board, a concave linking member concave downwardly from the first contacting protrusion, a second contacting protrusion connected with the concave linking member and formed as another convex portion for facing the first contacting protrusion for contacting a second side of the contact area of said daughter board and defining an aperture between said first and said second contacting protrusions, and a second spring arm member adjacent to the second contacting protrusion protruding sidewardly towards said second side wall in the slot opposite to the first side wall, the improvement which comprises: said second spring arm member having an upper bending portion secured to the second contacting protrusion and a lower free end portion pendant from the upper bending portion to approximate the base member; and said first spring arm member, said first contacting protrusion, said concave linking member, said second contacting protrusion and said second spring arm member of said contact element continuously connected to form an inversed omega shape.

whereby upon an insertion of said daughter board to be clamped by said two contacting protrusions, said daughter board is rotated to bias said contact element to allow said second spring arm member to bear against said second side wall in said slot for exerting multiple elastic forces in said contact element for efficiently clamping said daughter board.

* * * * *